US005319431A

United States Patent [19]

Lindblad et al.

[11] Patent Number: 5,319,431

[45] Date of Patent: Jun. 7, 1994

[54] APPARATUS FOR INCREASED TONER STORAGE CAPACITY

[75] Inventors: Nero R. Lindblad, Ontario; Richard L. Forbes, II, Pittsford, both of N.Y.

[73] Assignee: Xerox Corporation, Stamford, Conn.

[21] Appl. No.: 83,603

[22] Filed: Jun. 30, 1993

[51] Int. Cl.[5] ..... G03G 21/00

[52] U.S. Cl. ..... 355/299; 355/296

[58] Field of Search ..... 355/215, 296, 298, 299, 355/200, 210; 15/93.1, 97.1

[56] References Cited

U.S. PATENT DOCUMENTS

| | | | |
|---|---|---|---|
| 3,660,863 | 5/1972 | Gerbasi | 15/256.51 |
| 3,848,993 | 4/1974 | Hasiotis | 355/299 |
| 4,218,131 | 8/1980 | Ito et al. | 355/298 |
| 4,218,132 | 8/1980 | Iwai et al. | 355/299 |
| 4,255,044 | 3/1981 | Cormier et al. | 355/299 |
| 4,505,577 | 3/1985 | Koizumi | 355/298 |
| 4,561,766 | 12/1985 | Fox | 355/215 |
| 4,690,544 | 9/1987 | Forbes, II et al. | 355/299 |
| 4,875,081 | 10/1989 | Goffe et al. | 355/298 X |
| 4,989,047 | 1/1991 | Jungle et al. | 355/299 X |
| 5,122,839 | 6/1992 | Siegel et al. | 355/299 |
| 5,229,826 | 7/1993 | Sonnenberg | 355/298 |

FOREIGN PATENT DOCUMENTS

| | | | |
|---|---|---|---|
| 0095581 | 5/1985 | Japan | 353/299 |
| 0045977 | 2/1991 | Japan | 355/299 |
| 0350890 | 12/1992 | Japan | 355/299 |

*Primary Examiner*—A. T. Grimley
*Assistant Examiner*—Sandra L. Brasé
*Attorney, Agent, or Firm*—T. L. Fair

[57] ABSTRACT

A cleaning system for increasing the packing density of a sump fill. The cleaning system has a blade having an acute angle for removing residual particles from the photoreceptor surface. The acute angle of the blade creates a build up of toner and other residual particles on the cleaning blade. A support platen for the imaging surface is opposed to the cleaning blade to prevent damage to the imaging surface. The build up of toner and other residual particles is guided to the sump by a baffle causing tighter packing of the particles in the sump.

10 Claims, 4 Drawing Sheets

APPARATUS FOR INCREASED TONER STORAGE CAPACITY

BACKGROUND OF THE INVENTION

This invention relates generally to electrophotographic printing, and more particularly, concerns cleaning the imaging surface.

Cleaning failures in CRUs (Customer Replacement Units) fall into two basic categories. One is the broad band failures and, the second is fine line failures. Broad band streaks are the most common type of cleaning failure, and are predominantly caused by the effects of cleaner sump fill, especially when the cleaner cavity is located above the cleaner as in a 12 o'clock blade cleaner. Fine line failures are caused by either debris trapped under the blade,(i.e. paperfibers),or by nicks in the blade edge. However, fine line failures occur at a much lower rate than broad band failures, especially in a 12 o'clock blade cleaner.

The following disclosures may be relevant to various aspects of the present invention and may be briefly summarized as follows:

Gerbasi U.S. Pat. No. 3,660,863 discloses an elastomeric blade for removing dry particulate material from a surface to which the particulate material is electrostatically bonded. The elastomeric blade has an acute angle in pressure contact with the surface.

SUMMARY OF INVENTION

Briefly stated, and in accordance with one aspect of the present invention, there is provided an apparatus for cleaning a surface. The apparatus comprises a housing defining a cavity and a cleaning member having an edge. The cleaning member is at least partially enclosed in the housing. The cleaning member cleans residual particles from the surface. The cleaning member, contacts the surface, causing the residual particles to build up on the cleaning member. The cleaning member defines an acute angle between the cleaning member contacting the surface and the edge adjacent thereto. The apparatus also comprises means for guiding the residual particles cleaned from the surface into the cavity and means to support the surface opposed to the cleaning member.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Reference is now made to the drawings where the showings are for the purpose of illustrating a preferred embodiment of the invention and not for limiting same.

Figure 1:
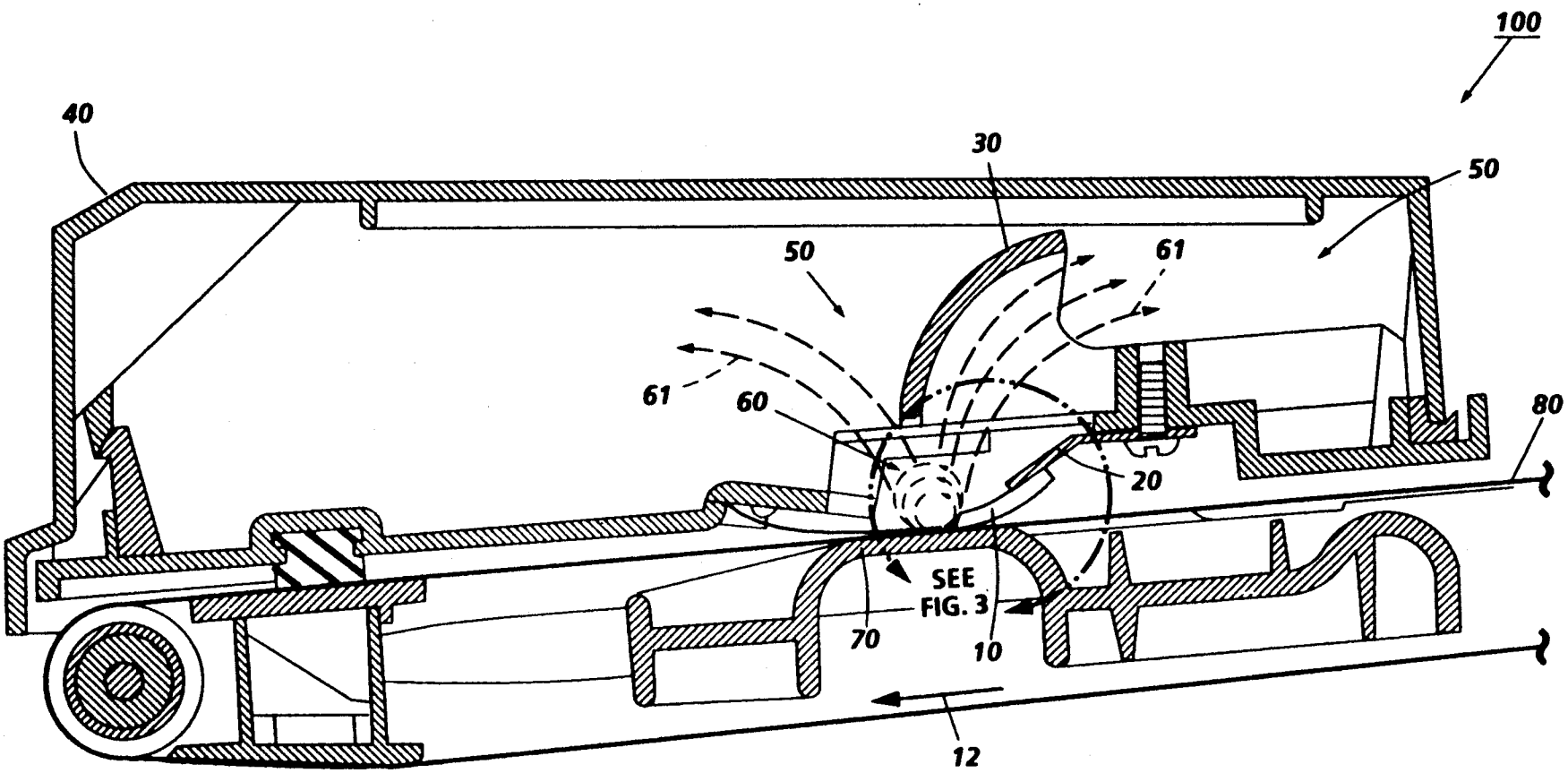
FIG. 1 is an elevational view of a CRU with the present invention contained therein.

Referring now to FIG. 1, which is a schematic diagram of the cleaning system in a CRU. A photoreceptor belt 80 is rotated in the direction of arrow 12. The blade 10, supported by a blade holder 20, contacts the surface (i.e. imaging or photoconductive) of the photoreceptor belt 80. The blade 10 has a cleaning edge for removing residual particles from the photoreceptor belt 80. On the opposite side of the photoreceptor belt 80 from the cleaning blade 10 is a blade support platen 70 to support the flexible photoreceptor belt 80 under the load being applied to the blade 10 for pressure contact with the photoreceptor surface. A cleaner housing 40 contains a cleaner cavity or sump 50 for collecting the toner and other residual particles removed from the photoreceptor by the blade 10. The passive sump fill baffle 30, extending from the cleaner housing wall toward the photoreceptor surface, guides the residual particles into the cleaner cavity 50 allowing a more even packing of the residual particles. This increases the holding capacity of the cleaner cavity 50 and extends the life of the cleaner system in the CRU.

As waste toner is cleaned from the photoreceptor belt 80 by the blade 10, a small rolling "log" of toner 60 is formed ahead of the blade 10. This log of toner 60 gradually grows upward above the blade 10 in a "volcano" like fashion, eventually covering the blade 10. The toner accumulated in this fashion is packed to a higher than normal density (for loose toner) due to the forces acting on it at the blade tip, which remove it from the photoreceptor belt 80, and move it away from the blade/photoreceptor interface. Also, since the cleaner sump 50 is at an elevated temperature due to its close proximity to the fuser (not shown) and precharge erase lamp (not shown), the sump 50 can approach the blocking temperature (i.e. the temperature at which toner starts to melt and congeal) of toner In certain long run modes. Therefore, the blade 10 can be covered by a "mountainous" pile 60 of toner which is densely packed, and may have areas of fused toner caked upon it. The result of which is that the blade 10 feels the effect of the toner lying on it and its tip geometry (i.e. the relationship of the cleaning edge and blade face to the photoreceptor) is altered in some way such that broad band cleaning failures occur. (A broad band cleaning failure is where the cleaning system has failed, leaving a band of toner on the imaging surface that is transferred to the copying media creating copy quality defects.)

With continuing reference to FIG. 1, the forces acting on the blade 10, in a 12 o'clock position, are affected by the pile of toner laying on the blade 10. The weight of the toner pile laying on the blade is probably insignificant. However, the reaction of this toner pile to incoming toner is not. Particularly, when the toner pile is not able to flow freely. The toner moving upwardly in the sump, (away from the blade/photoreceptor interface) shown by the dotted arrows 61, experiences a reaction force from the toner pile which resists the incoming toner. The normal and compressive forces, $F_N$ and $F_C$ respectively, shown in FIG. 4, which act on the blade 15 during operation, are modified in a way that causes increased planing and ultimately lifts the tip of the blade off of the photoreceptor surface causing a broad band cleaning failure. The 80° blade tip, of the present invention, has component forces, $F'_N$ and $F'_C$, shown in FIG. 5, which assist in keeping the blade 10 in contact with the photoreceptor 80 and directing toner away from the blade/photoreceptor surface. Thus, avoiding the resulting force which causes the tip of the blade to lift off of the photoreceptor belt when the tip angle is 90°.

Figure 2:
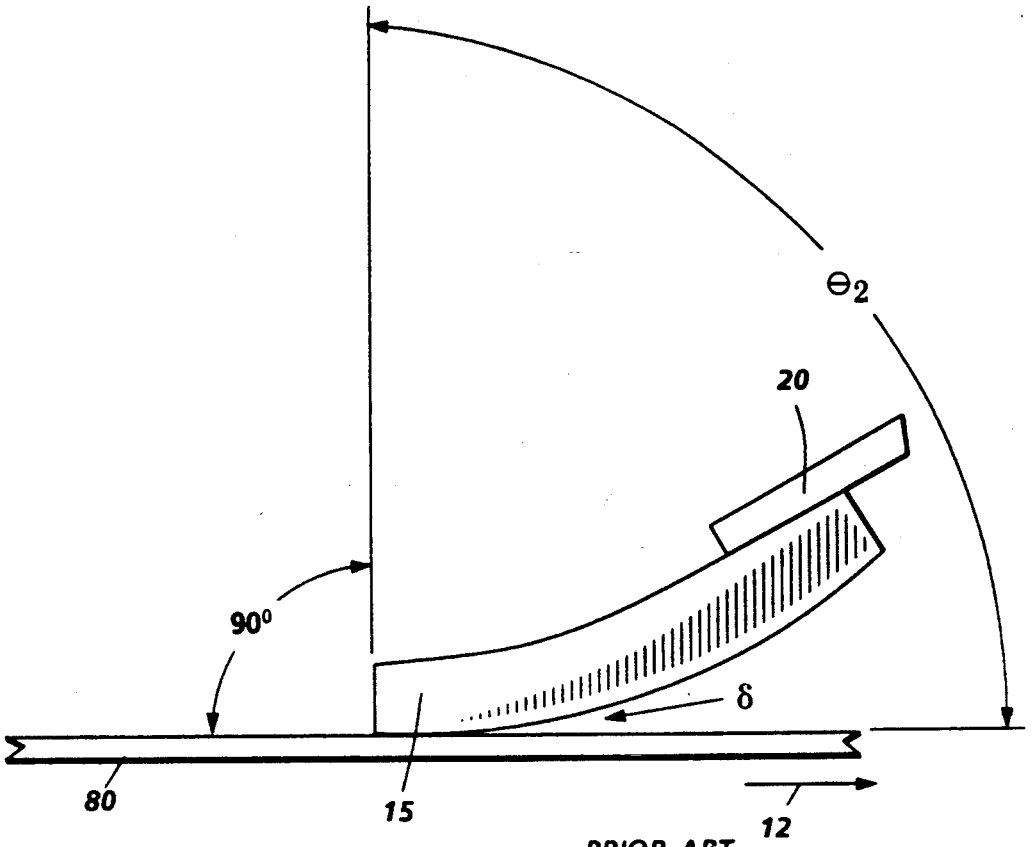
FIG. 2 PRIOR ART
FIG. 2 is a prior art view of a 90° blade tip angle.

Reference is now made to FIG. 2 which shows a common blade cleaner 15 that has about a 90° blade tip angle, $\theta_2$. A 90° blade has its cleaning edge surface cut at 90° to the bulk of the blade. Using a fixed cantilever beam design approach, the blade cleaner is loaded to the photoreceptor 80 at approximately 55 gms per cm. This high blade loading was found to be necessary for operation at 12 o'clock without an active toner mover in the sump 50. The high blade load was necessitated by the 12 o'clock cleaner position due to higher forces being required to overcome the toner pile laying on the blade. Due to the high blade load in deflection, the working angle, ∂, of the blade 15 is 0° which is planing. (i.e. Planing refers to a blade operating at a working angle of 0°. The working angle being defined as the angle between the tip of the blade and its adjacent blade surface, and the photoreceptor surface). The flat blade support platen 70 (see FIG. 1) allows the blade to operate in the planing mode, which is unheard of for a drum photoreceptor in similar systems. By comparison, the Xerox 1065 machine and the Xerox 5046 machine blade loads are in the 30 to 35 gm per cm range. Even a Xerox 5028 style cleaner, as in the present invention, will operate at 35 gms per cm, but not for very long.

Figure 3:
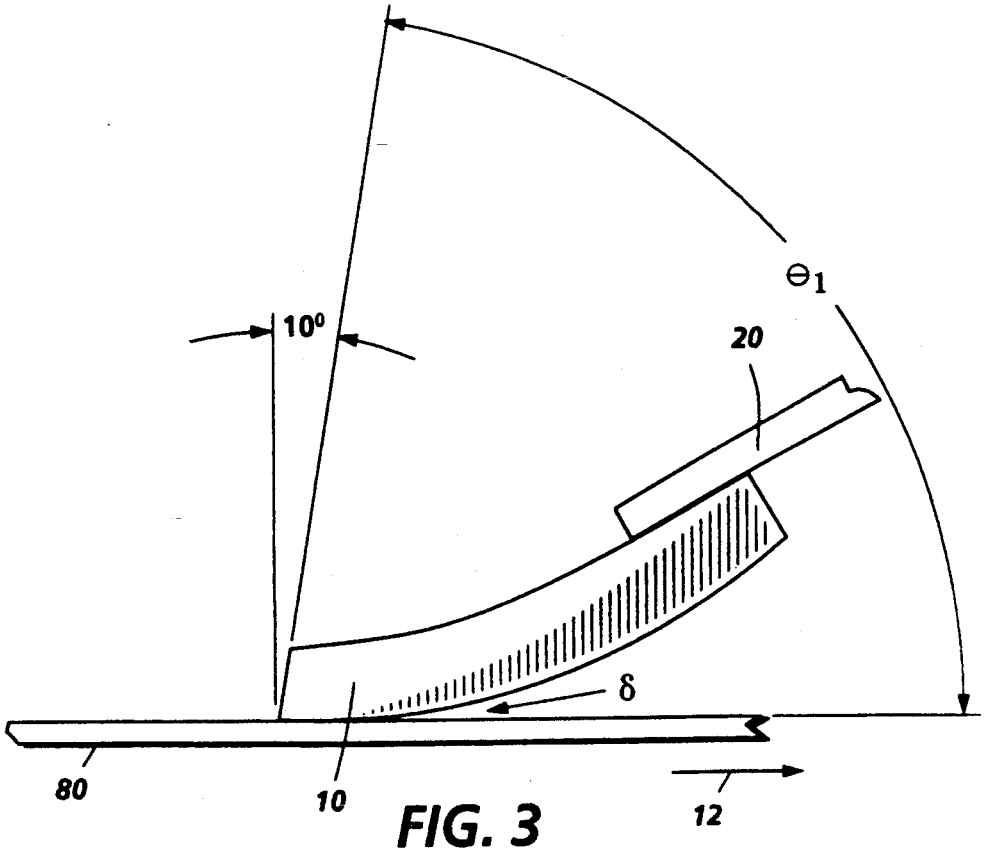
FIG. 3 is a view of an 80° tip angle of the present blade cleaning apparatus.

Reference is now made to FIG. 3, which shows $\theta_1$, the blade cleaner 10, of the present invention, that has about an 80° blade tip angle. The blade 10 working angle, ∂, Is still 0°, but the tip angle is about 80°±5° from the photoreceptor belt. The 80° blade tip angle modifies the forces on the blade/blade tip due to the effects of the toner pile that accumulates above the blade 10.

Figure 4:
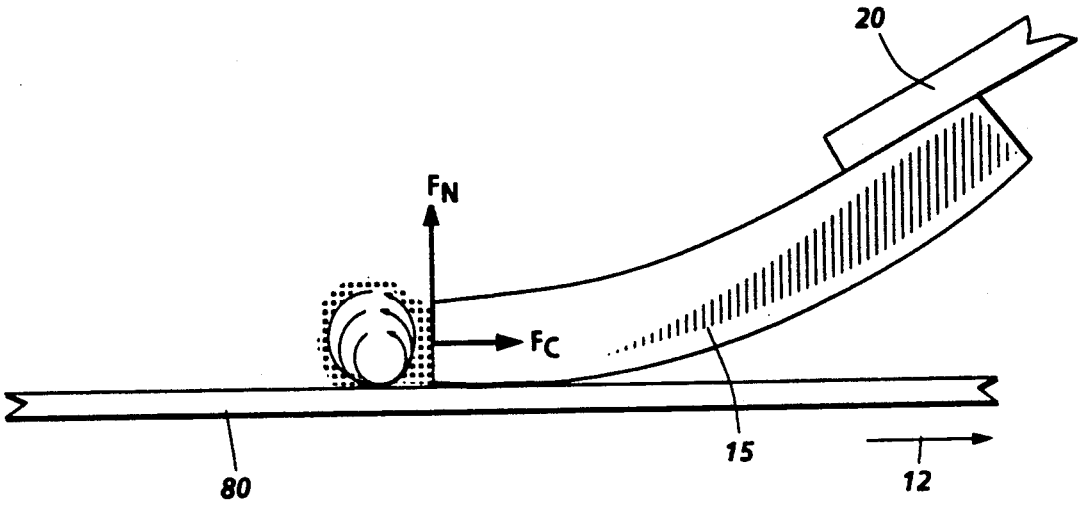
PRIOR ART FIG. 4
FIG. 4 shows the forces exerted on the blade tip angle of 90°.

FIG. 4 shows the 90° blade and the rolling "log" of toner 60 in front of the blade tip. Also shown is a hypothetical vector force, F, (i.e. consisting of $F_N$ and $F_C$) resulting from the forces acting on the blade tip at the photoreceptor interface.

Figure 5:
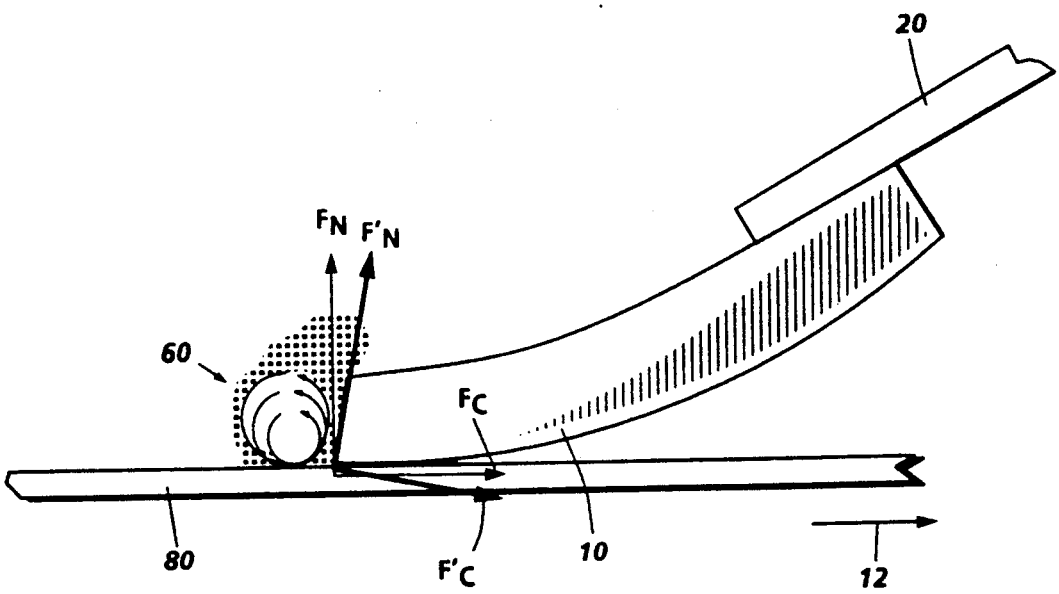
FIG. 5 shows the forces exerted on the blade tip angle of 80° in the present invention and FIG. 6 graphically shows the experimental results of the toner weight at failure for 80° and 90° blade tip angles.

FIG. 5 shows an 80° blade tip angle, its hypothesized vector force, F' (i.e. consisting of $F'_N$ and $F'_C$) and the rolling log of toner 60 as it starts to pile on top of the blade 10. The 80° blade allows the force, F', to be generated that helps to hold the blade tip down, or at least resist lifting off of the photoreceptor 80.

Figure 6:
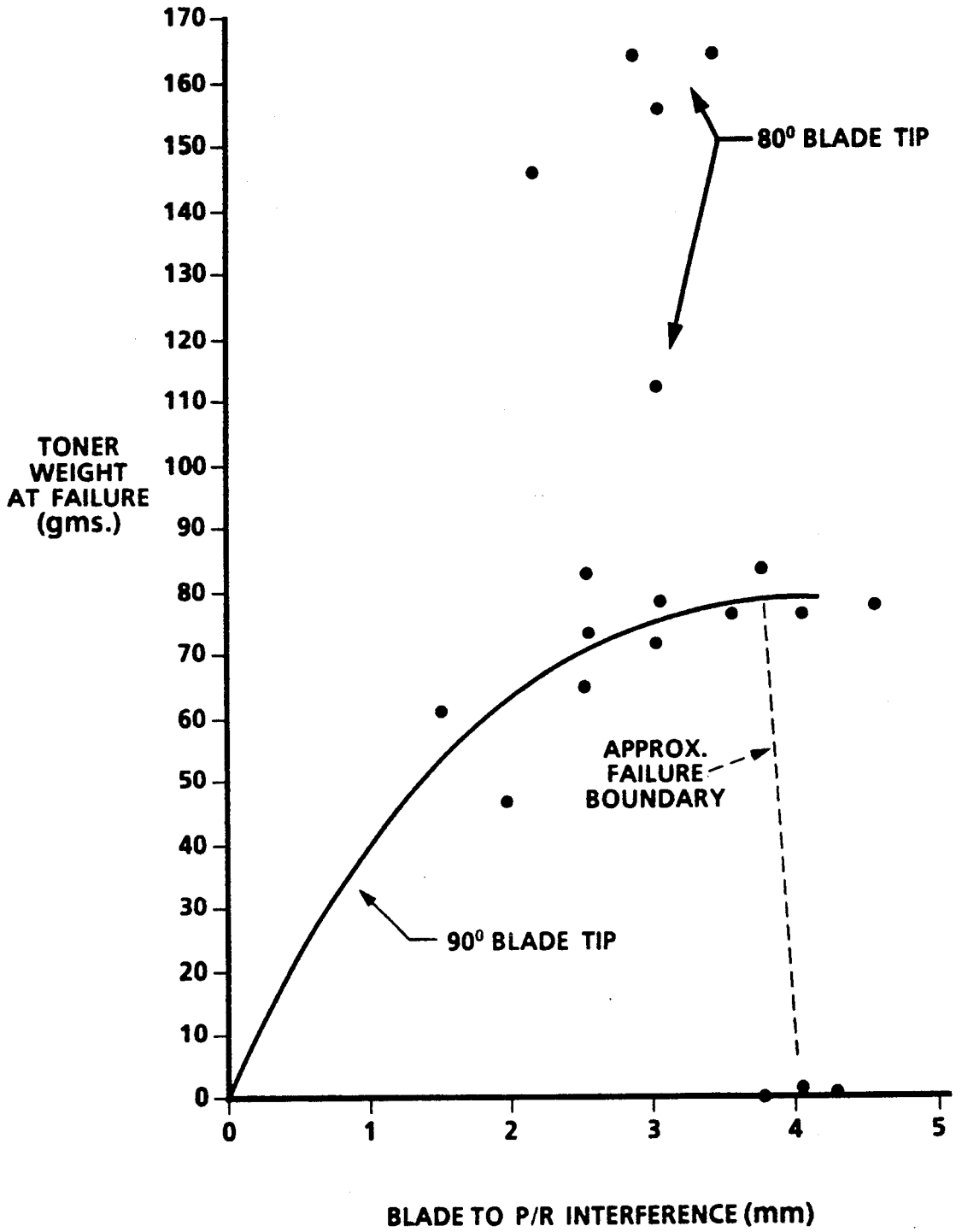

Referring now to FIG. 6, which shows the experimental results of a reduced sump sized stress test (i.e. mini-sump test). A "roof" was placed over the blade approximately 10 mm above the photoreceptor surface. This was done to shorten the sump fill test time and create a real impedance to toner flow in the sump. The "standard" 90° blade was tested beyond its predicted operating blade-to-photoreceptor interference range. [(i.e. Planing is predicted to occur at approximately 2.6 mm interference by a mathematical model. Testing was performed on the present invention, from the range of 2 mm to 4.5 mm interference with a blade holder angle of 26°±1°. (Nominal interference is 3 mm±0.5 mm.)] The 80° blade was initially tested at what would be a nominal setting. This graph shows that the 80° blade performed significantly better, at least 1.5 times better, than the 90° blade.

In recapitulation, it is evident that the cleaning apparatus of the present invention includes a blade with an acute angle, having a high load and a baffle to guide particles removed from the surface into a sump thereby increasing the packing density of the sump fill. The present invention discloses a way to increase the toner storage capacity by simply changing the cut angle of the blade tip from 90° to 80±5°, adding a higher load on the blade cleaner and adding a baffle to guide residual particles. Thus, this idea does not increase the cost of the blade, it does not increase the size of the cleaner sump, and it does not introduce a mechanical device to pack the toner in the cleaner cavity. Therefore, the customer replacement unit life is improved through a reduced failure rate without an increase in the unit manufacturing cost (UMC).

It is, therefore, evident that there has been provided in accordance with the present invention, a blade having an acute angle with a baffle guide. The cleaning blade apparatus of the present invention fully satisfies the objects, aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

It is claimed:

1. An apparatus for cleaning an imaging surface, comprising:

a housing defining a cavity;

a blade, at least partially enclosed in said housing, said blade having one end coupled to said housing and a free end opposite thereto, said free end having at least a first blade surface and a second blade surface, said first blade surface being adjacent to said second blade surface defining an acute angle therebetween, said free end further defining an edge between said first blade surface and said second blade surface, said edge contacting the imaging surface to remove residual particles therefrom;

means for guiding the residual particles cleaned from the imaging surface into said cavity, said guiding means evenly packing the residual particles in said cavity increasing holding capacity therein; and means for supporting the imaging surface opposed to said blade.

2. An apparatus as recited in claim 1, wherein said edge comprises a line where said second blade surface and said first blade surface meet, said line contacts the imaging surface.

3. An apparatus as recited in claim 2, wherein said edge contacting the imaging surface causes the residual particles to build up on said blade.

4. An apparatus as recited in claim 3, wherein said support means comprises a blade platen.

5. An apparatus as recited in claim 4, wherein said guiding means comprises a baffle.

6. An apparatus as recited in claim 5, wherein said baffle, has a first and a second end, said first end being coupled to said housing, and said second end being free, extending from said housing toward the imaging surface.

7. An apparatus as recited in claim 6, wherein said baffle is enclosed in said housing.

8. An apparatus as recited in claim 7, wherein said blade is positioned subjacent to said baffle.

9. An apparatus as recited in claim 8, wherein said acute angle ranges from 75 degrees to 85 degrees from the imaging surface.

10. An apparatus as recited in claim 9, wherein the imaging surface comprises a photoconductive belt.

* * * * *